US005100180A

United States Patent [19]

Tucker

[11] Patent Number: 5,100,180

[45] Date of Patent: Mar. 31, 1992

[54] RETAIL COUPON DOCUMENT

[75] Inventor: Larry H. Tucker, Saddle River, N.J.

[73] Assignee: Larry H. Tucker, Inc., Woodcliff Lake, N.J.

[21] Appl. No.: 669,601

[22] Filed: Mar. 14, 1991

[51] Int. Cl.[5] ..... B42D 15/00

[52] U.S. Cl. ..... 283/105; 206/831; 229/70; 283/56; 283/903; 428/416

[58] Field of Search ..... 428/42, 946, 43; 206/831; 229/70; 283/56, 102, 103, 104, 105, 106, 107, 108, 903

[56] References Cited

U.S. PATENT DOCUMENTS

| | | | |
|---|---|---|---|
| 3,524,782 | 8/1970 | Buske | 283/103 X |
| 3,734,544 | 5/1973 | Fishkin et al. | 283/56 |
| 4,318,235 | 3/1982 | Augeri | 206/831 X |
| 4,345,393 | 8/1982 | Price et al. | 206/831 X |
| 4,722,554 | 2/1988 | Pettit | 283/105 |
| 4,817,390 | 4/1989 | Krost | 283/56 X |

*Primary Examiner*—Paul A. Bell

*Attorney, Agent, or Firm*—Burns, Doane, Swecker & Mathis

[57] ABSTRACT

A retail coupon document contains two coupons which are hidden from a coupon user, the coupons being for different values. The user selects and pulls one of two intersecting pull strips, thereby revealing one of the coupons and destroying the other, depending upon which pull strip is selected. The pull strips are formed by perforated division lines which are so arranged that a downstream portion of each pull strip passes through one of the coupons. Thus, the revealed (non-destroyed) coupon will possess such downstream perforations. The perforated lines are configured such that each pull strip is less resistant to being pulled off in an upstream portion thereof than in a downstream portion thereof. This ensures that the revealed coupon will not be unduly weakened by the presence of perforations therein.

6 Claims, 3 Drawing Sheets

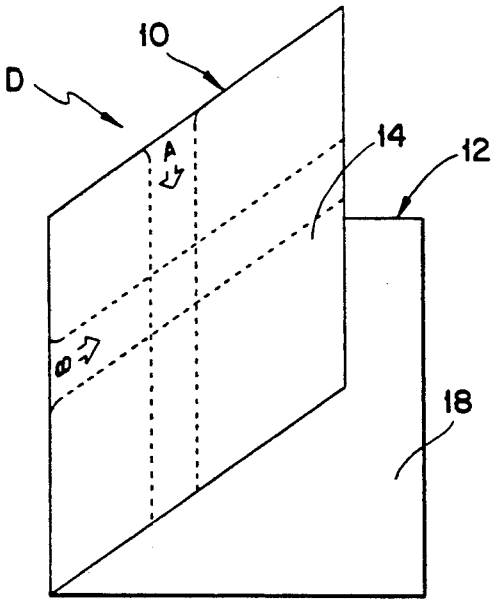
FIG. 5
FIG. 7
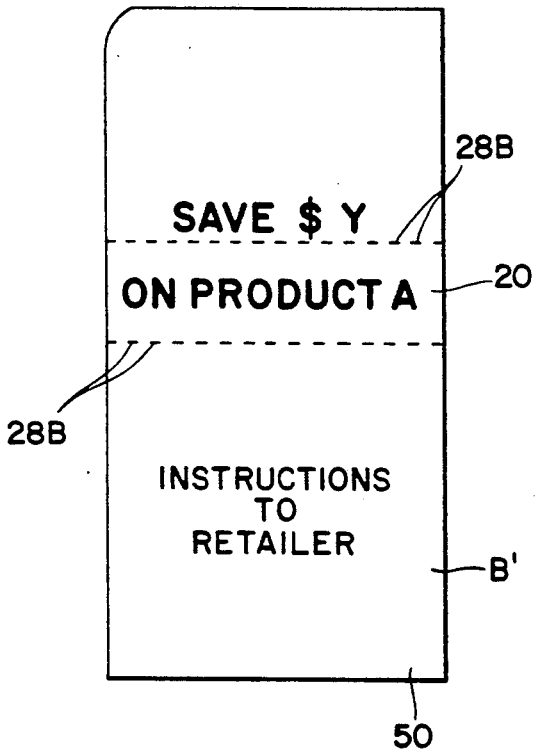
FIG. 6
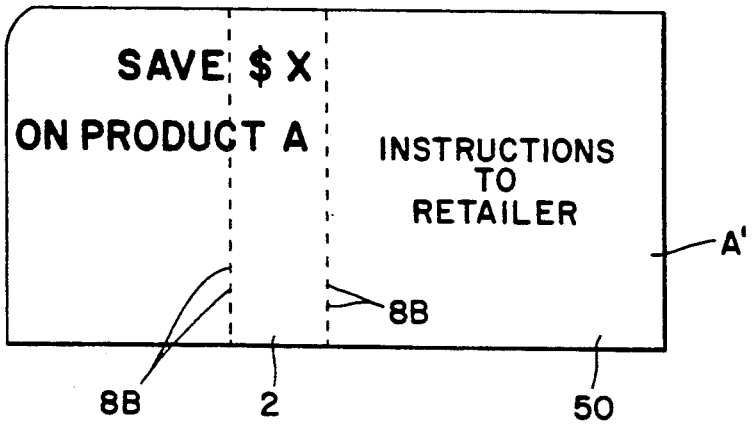

RETAIL COUPON DOCUMENT

BACKGROUND OF THE INVENTION

This invention relates to retail coupon documents.

Previously proposed in Krost U.S. Pat. No. 4,817,990 is a retail coupon document in which two coupons (or values) are hidden from the consumer and wherein one of the coupons (or values) is destroyed by the consumer in response to opening the coupon document. A manufacturer is able to issue or sponsor such a coupon document in order to target the users of a competitor's product and present them with an incentive for switching to the sponsor's product. That is, each of the hidden coupons would present the consumer with a value (e.g., a discount) for using the sponsor's product. However, one of the coupons would offer a greater value than the other and would be directed to the user of the competitor's product.

Such direction would be accomplished by means of instructions imprinted on the front side of the document. Those instructions would be calculated to ensure that the opening technique employed by users of the competitor's product would result in the lesser value coupon being destroyed and the greater value coupon being revealed. Conversely, the opening technique employed by users of the sponsor's product would result in the greater value coupon being destroyed and the lesser value coupon being revealed. The greater value received by the user of the competitor's product would serve as an incentive to switch products.

The coupon document itself constitutes two paper panels glued together along their borders. Each panel thus presents a hidden side (which faces the hidden side of the other section) and a exposed side (which constitutes the front or rear side of the coupon document). Two coupons are imprinted on one of the inner sides in an overlapping fashion, and instructions for opening the coupon document are imprinted on one of the exposed sides. Those document-opening instructions require the user to sever the panels along predefined division lines which are visible to the user. The user is instructed to chose between two different division lines, depending upon whether the user is a user of the competitor's product or the sponsor's product. The user will reveal a coupon for the sponsor's product regardless of which division lines are chosen. However, the division lines presented to users of the competitor's product serve to destroy the lesser value coupon and reveal the greater value coupon, whereas the division lines presented to the user of the sponsor's product serve to destroy the greater value coupon and reveal the lesser value coupon.

It has been found that division lines comprised of, for example, conventional perforations such as disclosed in Fishkin U.S. Pat. No. 3,734,544, may present a serious shortcoming by excessively weakening the structural integrity of the revealed (surviving) coupon. That is, after the user opens the coupon document along a selected one of the perforated division lines, the revealed coupon will also possess the perforations of the non-selected division lines. The presence of those remaining perforations in the revealed coupon makes the revealed coupon susceptible to being accidentally separated along those perforations as a consequence of the coupon being handled by the user.

A variation of the Krost coupon document has been previously proposed in which the coupon includes a means or tool for tearing along the division lines, namely, a pair of zipper pulls which are integral with one of the panels. Those zipper pulls form manually actuable tools which effectively cut through one of the panels (but not the other panel) along the perforated division lines when pulled by the user. Although this variation requires that only one of the panels of the coupon document be cut, it still embodies the earlier described shortcoming wherein the revealed coupon is excessively weakened by the presence of the non-selected perforated division lines.

SUMMARY OF THE INVENTION

The present invention involves a retail coupon document comprising first and second panels which are removably joined together by adhesive along their peripheral edges. The first panel includes an exposed outer side and a hidden inner side. The inner side is imprinted with coupon indicia to define first and second intersecting retail coupons which are mutually overlapped to form a common section therebetween. The first panel includes first and second pull strips defined by first and second pairs of perforated division lines, respectively, arranged to intersect one another. The first pair of perforated division lines is offset from the first coupon and extends through the second coupon. The second pair of perforated division lines is offset from the second coupon and extends through the first coupon, so that a pulling of the first pull strip enables the first coupon to be revealed and the second coupon to be destroyed, and a pulling of the second pull strip enables the second coupon to be revealed and the first coupon to be destroyed. Each of the first and second pull strips includes an upstream section which is offset from both of the first and second coupons, and a downstream section which passes through a respective one of the coupons. The perforated division lines are arranged such that each pull strip is less resistant to being pulled off along the upstream section thereof than along the downstream section thereof.

Hence, the integrity or stability of the downstream section is greater than in the upstream section.

That is preferably achieved in that the perforation-length percentage of the perforated division lines is greater in the upstream sections than in the downstream sections, in order to facilitate the initial pulling of a pull strip while increasing the integrity of a revealed coupon.

Preferably, the downstream section of each pull strip immediately follows a zone of intersection of the pull strips. It is also preferable that the coupons are oriented perpendicularly to one another to form an L-shape, and that the pull strips are oriented perpendicularly to one another and intersect one another intermediate the ends of each pull strip.

Preferably, each of the upstream sections of the pull strips includes an outwardly flared upstream end which is defined by preformed through-cuts in the first panel.

BRIEF DESCRIPTION OF THE DRAWINGS

The objects and advantages of the invention will become apparent from the following detailed description of a preferred embodiment thereof in connection with the accompanying drawings in which like numerals designate like elements, and in which:

FIG. 5 is an exploded perspective view of a coupon document according to the present invention;

FIG. 6 is a front view of a first coupon which can be formed from the first panel; and FIG. 7 is a front view of a second coupon which can be formed from the front panel.

DETAILED DESCRIPTION OF A PREFERRED EMBODIMENT OF THE INVENTION

Depicted in FIG. 5 is a coupon document D according to the present invention in an exploded perspective view. That document comprises first and second rectangular panels 10, 12 which are glued together along their four peripheral borders. The panels are formed of paper and the glue is of a type enabling the panels to be later peeled apart by a coupon user without destroying the paper or damaging the printing thereon, e.g., the glue can be a type available from the National Starch Co. of Milburn, N.J.

Figure 1:
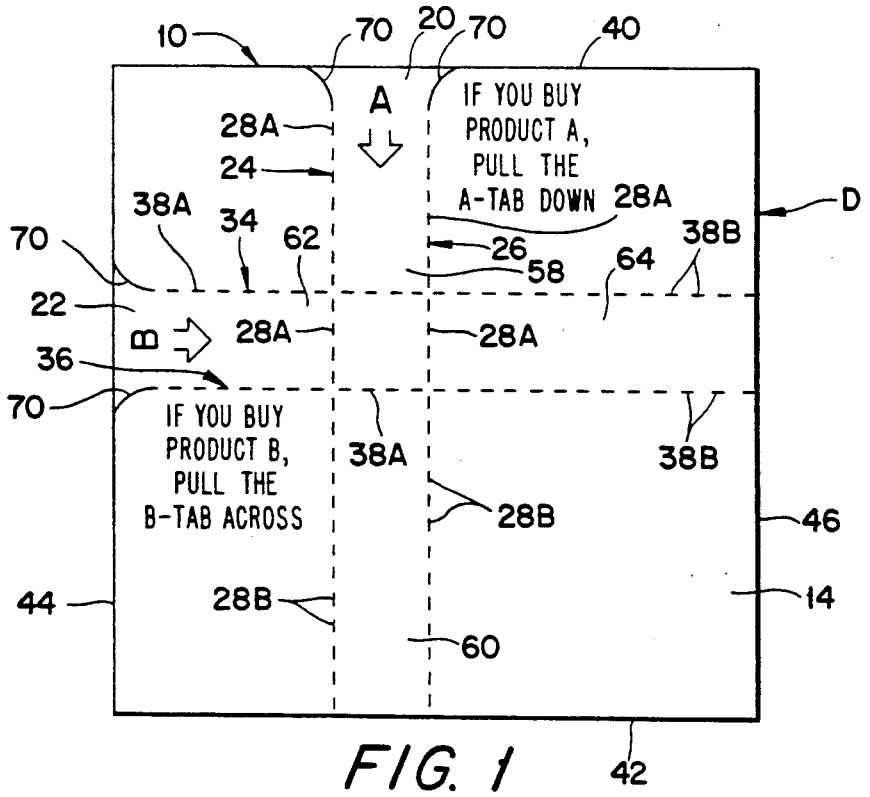
FIG. 1 is a front view of an exposed side of a first panel of a coupon document according to the present invention, with first and second pull strips thereof being intact.
Figure 2:
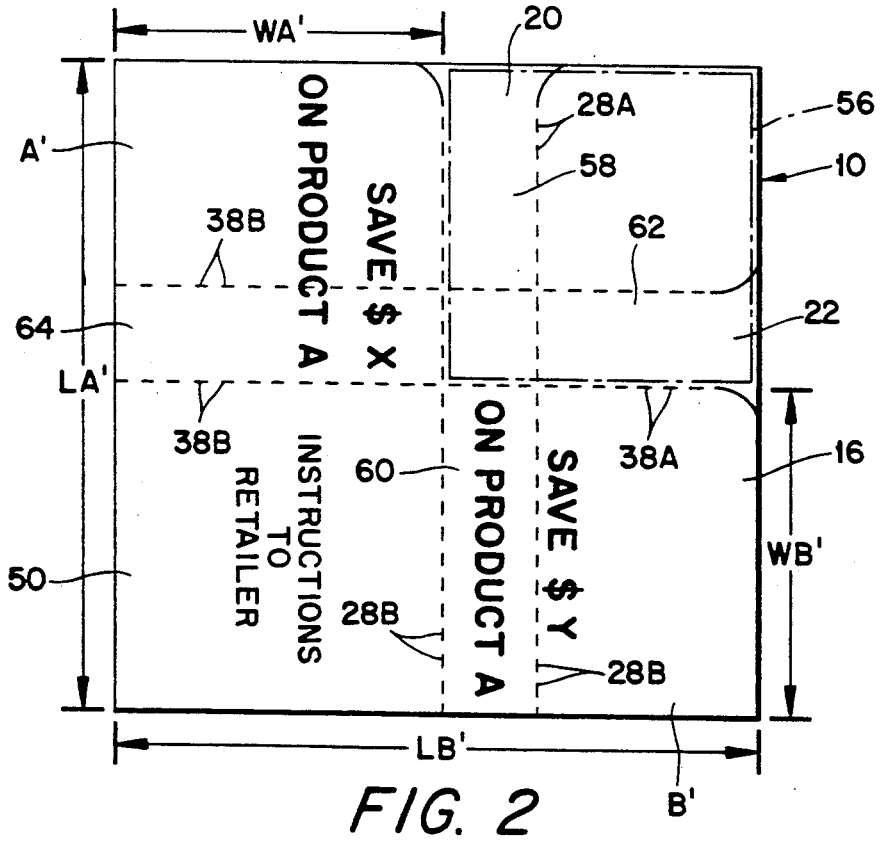
FIG. 2 is a view of the reverse or hidden side of the panel depicted in FIG. 1, with the first and second pull strips remaining intact.

The first panel 10 includes an outer exposed side 14 depicted in FIG. 1, and an inner side 16 depicted in FIG. 2 (the latter side 16 being hidden once the panels have been glued together). The second panel also has an exposed side (not shown) and an inner hidden side 18 (see FIG. 5) which faces the hidden side 16 of the first panel.

The first panel 10 is provided with first and second intersecting pull strips 20, 22 having end tabs marked A and B, respectively. The first pull strip 20 is defined by a set of division lines, i.e., two parallel division lines 24, 26, with each division line being formed by spaced perforations 28A, 28B to be later described in greater detail. Likewise, the second pull strip 22 is defined by a set of division lines, i.e., two parallel division lines 34, 36 formed by spaced apart perforations 38A, 38B to be later described in greater detail.

The first pull strip 20 extends between opposing edges 40, 42 of the first panel, and the second pull strip 22 extends between the remaining opposing edges 44, 46.

FIG. 2 depicts the hidden side 16 of the first panel 10. Two coupons A' and B' are imprinted on that hidden side 16 which intersect one another perpendicularly to form an L-shape. Coupon A' has a length LA' and a width WA', whereas coupon B' has a length LB' and a width WB'. A rectangular region 50 of intersection or overlap of the coupons is thus defined at the corner of the L-shape. That overlap region 50 may be imprinted with instructions to the retailer which are common to both of the coupons.

The coupons A' and B' are imprinted with different values. For example, coupon A' provides a discount of X dollars, and the coupon B' provides a discount of Y dollars, with amount X being less than amount Y. Both coupons are valid only for the purchase of product A, however.

It will be appreciated that the first pull strip 20 is offset from, and parallel to, the first coupon A' and the second pull strip 22 is offset from, and parallel to, the second coupon B'. In fact, one of the division lines 26 of the first pull strip 20 forms a longitudinal edge of the first coupon A', and one of the division lines 36 of the second pull strip 22 forms a longitudinal edge of the second coupon B'.

It will also be appreciated that a section of the first pull strip 20 extends through the second coupon B', and a section of the second pull strip 22 extends through the first coupon A'.

From the foregoing, it will be apparent that if a user pulls the first pull strip 20, the latter will sever, and thus destroy, the second coupon B', whereas the first coupon A' will remain intact. Likewise, if the second pull strip 22 is pulled, the first coupon A' will be destroyed, and the second coupon B' will remain intact.

Figure 3:
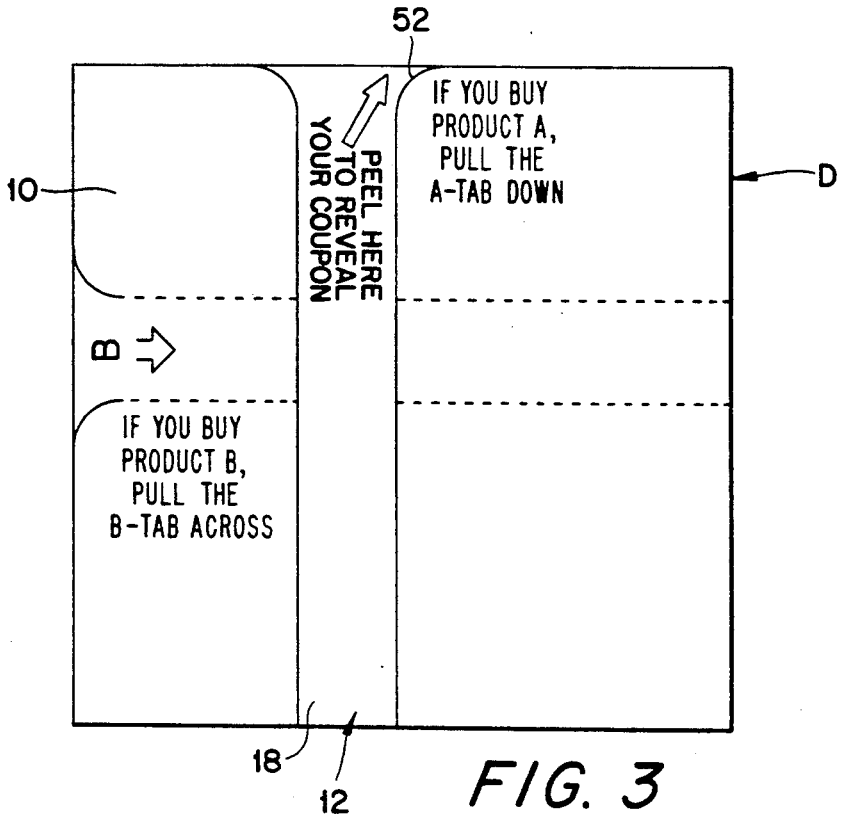
FIG. 3 is a view similar to FIG. 1 after a first of the pull strips has been removed.
Figure 4:
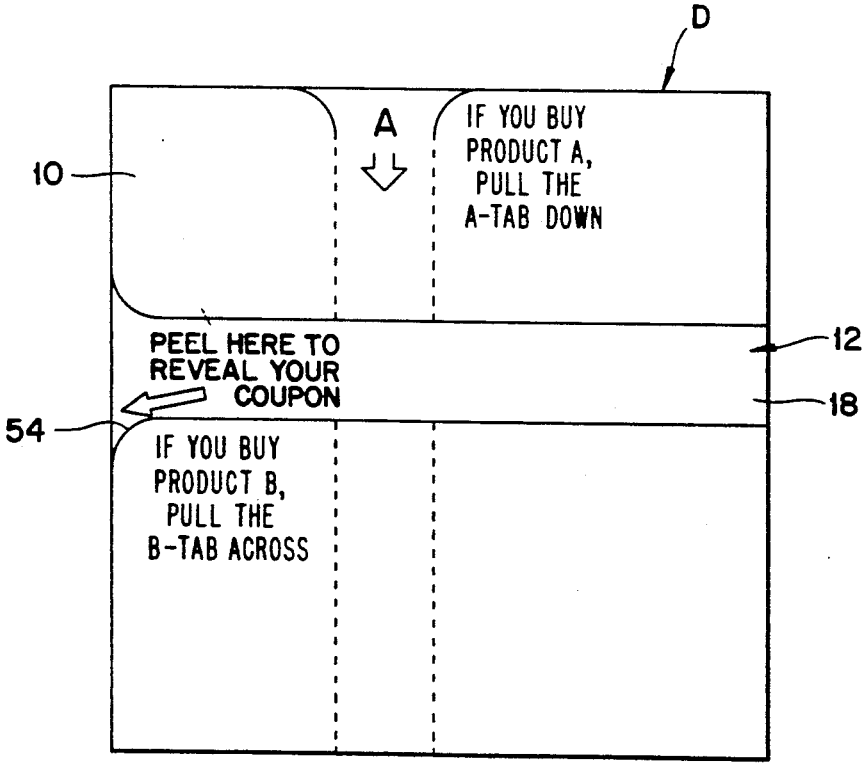
FIG. 4 is a view similar to FIG. 1 after a second of the pull strips has been removed.

Suitable instructions are imprinted on the inner (hidden) side 18 of the second panel 12 which become exposed once a respective one of the pull strips 20, 22 is pulled off. Those instructions are shown in FIGS. 3 and 4 which depict the front of the coupon document after the pull strips 20 and 22, respectively, have been pulled off. The instructions instruct the user where to peel the first panel in order to separate the first (or second) coupon from the second panel.

Thus, if the first pull strip A' has been pulled-off (see FIG. 3), the user is instructed to peel in the vicinity 52, whereby the first coupon A' is peeled off and revealed as shown in FIG. 6. On the other hand, if the user chooses instead to pull off the second pull strip 22, the exposed instructions will instruct the user to peel in a vicinity 54, whereupon the second coupon B', is peeled off and revealed as shown in FIG. 7. Only one of the two coupons A', B' can be revealed, since the revealing of one coupon results in the destruction of the other coupon.

Various types of offers can be made to the user, causing him to choose between the two pull strips 20, 22. For example, a manufacturer of product A may sponsor the distribution of the coupon document whose instructions will direct a user of product A to reveal the first coupon A', and direct a user of a competitor's product B to reveal the second coupon B'. As a result, the user of the competitor's product receives a greater discount for product A (i.e., amount Y being greater than amount X) in order to entice that user to switch to product A. That type of offer is merely exemplary; other types of offers could be made.

It will be appreciated that, regardless of which coupon is revealed, that revealed coupon will contain some of the perforated division lines of the non-chosen pull strip. Such remaining perforations inherently weaken the coupon and may lead to an inadvertent destruction of the coupon as the result of normal handling by the user.

In accordance with the present invention, that problem is alleviated by a unique arrangement of the perforations. In that regard, it can be seen that each of the pull strips 20, 22 includes an upstream section which is offset from both coupons, and a downstream section which passes through a coupon. (The expressions "upstream" and downstream are defined with reference to the direction in which the pull strip is pulled.) For example, with reference to FIG. 2, the first pull strip 20 includes an upstream section 58 which passes through a non-coupon area 56 (outlined in phantom in FIG. 2) of the first panel 10, and a downstream section which passes through the second coupon B'. Likewise, the second pull strip 22 includes an upstream section 62 which passes through the non-coupon area 56, and a downstream section 64 which passes through the first coupon A'. In accordance with the present invention, each pull strip is less resistant to being pulled off along its upstream section than along its downstream section. That is preferably achieved by making the perforations of the upstream sections are longer in length than the perforations of the respective downstream sections, leaving a longer non-perforated spacing or paper tie between the perforations in each downstream section as compared with its respective upstream section. Thus, the upstream perforations 28A of the first pull strip 20 are longer than the downstream perforations 28B, and the upstream perforations 38A of the second pull strip 22 are longer than the downstream perforations 38B.

Consequently, the percentage of the length of each division line which is perforated (i.e., the perforation-length percentage) is greater in the upstream section than in the downstream section. That means that the upstream sections 58, 62 are more readily pulled-off, whereas the downstream sections 60, 64 are more stable. Accordingly, the revealed coupon will not be unduly weakened by the presence of a set of "downstream" division lines therein.

Also, the user should be able to successfully pull off the chosen pull strip, despite the higher integrity or stability of the downstream section thereof, due to the presence of the more easily pullable upstream section which enables the pulling operation to be easily initiated. In that regard, each pull strip includes two preformed initial cuts 70 which are flared. Those cuts 70 enable a user to bend up the initial end of the pull strip to secure a grip thereon. The longer upstream perforations then able the user to easily begin the tearing process. Once initiated, the tearing process will tend to continue along the downstream section, despite the grater stability of the latter.

It is preferred that the perforations 28, 38 do not extend completely through the thickness of the panel, so as to avoid unduly weakening the coupon document.

It is possible to reduce the perforation-length percentage of the downstream perforation lines by simply shortening the perfing blades in a conventional press used to create the perforated division lines. Thus, in a series of one-eighth inch blades used to make the perforations, some or all of the blades could be nicked, e.g., at their center, to create additional paper ties. It may be necessary to shorten only a few of the blades; that is, the downstream division lines may comprise perforations of varying lengths, separated by paper ties of varying lengths.

In operation, a user chooses one of the pull strips 20, 22 on the basis of the imprinted instructions. The user bends up the initial, flared end of the chosen pull strip, with the aid of the pre-made cuts 70, and then begins to pull the pull strip. Initiation of the pulling process is facilitated by the longer lengths of the upstream perforations 28A (or 38A). Once underway, the pulling process is able to pass successfully through the downstream perforations, despite the fact that the latter are shorter and separated by longer paper ties. The pull strip travels parallel to one of the coupons A', B' and perpendicular to and through the other of the coupons so as to destroy the latter. If the first pull strip 20 was chosen, then the second coupon B' will have been destroyed, and instructions will appear (see FIG. 3) for peeling off the first coupon A' at vicinity 52. After being peeled off and revealed, the first coupon A' will appear as shown in FIG. 6.

Alternatively, if the second pull strip 22 is chosen, then the first coupon A' will be destroyed, and the second coupon B' will be revealed as shown in FIG. 7.

The relative lengths of the upstream and downstream perforations will vary, depending for example on the characteristics of the panel such as type of paper, thickness of the panel, etc. Given the teachings of the present invention, one skilled in the art can, by experimentation, easily determine a proper relationship of perforation lengths suitable to the panels being employed. The panel 10 can be of single or double ply.

Although the present invention has been described in connection with a preferred embodiment thereof, it will be appreciated by those skilled in the art that additions, modifications, substitutions, and deletions not specifically described may be made without departing from the spirit and scope of the invention as defined in the appended claims.

What is claimed is:

1. A retail coupon document comprising first and second panels removably joined together by adhesive along their peripheral edges;

said first panel including an exposed outer side and a hidden inner side, said inner side being imprinted with coupon indicia to define first and second intersecting retail coupons which are mutually overlapped to form a common section therebetween, said first panel including first and second pull strips defined by first and second pairs of perforated division lines, respectively, arranged to intersect one another;

said first pair of perforated division lines being offset from said first coupon and extending through said second coupon, said second pair of perforated division lines being offset from said second coupon and extending through said first coupon, so that a pulling of said first pull strip enables said first coupon to be revealed and said second coupon to be destroyed, and a pulling of said second pull strip enables said second coupon to be revealed and said first coupon to be destroyed, each of said first and second pull strips including an upstream section which is offset from both of said first and second coupons, and a downstream section which passes through a respective one of said coupons, said perforated division lines being arranged such that each pull strip is less resistant to being pulled-off along said upstream section thereof than along said downstream section thereof, whereby the integrity of said downstream section is greater than said upstream section.

2. A coupon document according to claim 1, wherein the perforation-length percentage of said perforated division lines is greater in said upstream sections than in said downstream sections in order to facilitate the initial pulling of a pull strip while increasing the integrity of a revealed coupon.

3. A coupon document according to claim 1, wherein said downstream section of each of said pull strips immediately follows a zone of intersection of said pull strips.

4. A coupon document according to claim 1, wherein said coupons are oriented perpendicularly to one another to form an L-shape, said pull strips oriented perpendicularly to one another and intersecting one another intermediate the ends of each pull strip.

5. A coupon document according to claim 1, wherein each of said upstream sections includes an outwardly flared upstream end defined by pre-formed through-cuts in said first panel.

6. A retail coupon document comprising first and second panels removably joined together by adhesive along their peripheral edges;

said first panel including an exposed outer side and a hidden inner side, said inner side being imprinted with coupon indicia to define first and second intersecting retail coupons which are mutually overlapped to form a common section therebetween, said first panel including first and second pull strips defined by first and second pairs of perforated division lines, respectively, arranged to intersect one another, said coupons being oriented perpendicularly to one another to form an L-shape, said pull strips being oriented perpendicularly to one another and intersecting one another intermediate the ends of each pull strip, said first pair of perforated division lines being offset from said first coupon and extending through said second coupon, said second pair of perforated division lines being offset from said second coupon and extending through said first coupon, so that a pulling of said first pull strip enables said first coupon to be revealed and said second coupon to be destroyed, and a pulling of said second pull strip enables said second coupon to be revealed and said first coupon to be destroyed, each of said first and second pull strips including an upstream section which is offset from both of said first and second coupons, and a downstream section which passes through a respective one of said coupons, said downstream section of each of said pull strips immediately following a zone of intersection of said pull strips, the perforation-length percentage of said perforated division lines being grater in said upstream sections than in said downstream sections in order to facilitate the initial pulling of a pull strip while increasing the integrity of a revealed coupon.

* * * * *